US010045634B2

(12) United States Patent
Salazar et al.

(10) Patent No.: US 10,045,634 B2
(45) Date of Patent: Aug. 14, 2018

(54) INFANT CARRIER WITH ADJUSTABLE SIDE PANELS AND TORSO BAND

(71) Applicant: Blue Box Opco LLC, San Diego, CA (US)

(72) Inventors: Maureen O'Connor Salazar, Chicago, IL (US); Leslie Ann Roeder, New York, NY (US)

(73) Assignee: BLUE BOX OPCO LLC, San Diego, CA (US)

( * ) Notice: Subject to any disclaimer, the term of this patent is extended or adjusted under 35 U.S.C. 154(b) by 167 days.

(21) Appl. No.: 14/557,970

(22) Filed: Dec. 2, 2014

(65) Prior Publication Data

US 2016/0150893 A1 Jun. 2, 2016

(51) Int. Cl.
*A47D 13/02* (2006.01)

(52) U.S. Cl.
CPC ..... *A47D 13/025* (2013.01)

(58) Field of Classification Search
CPC ..... A47D 13/02; A47D 13/025
USPC ..... 224/158–160
See application file for complete search history.

(56) References Cited

U.S. PATENT DOCUMENTS 2,477,164 A * 7/1949 Bergman ..... A47D 13/025 224/159
2,599,474 A * 6/1952 Mills ..... A47D 13/025 224/160
3,229,873 A * 1/1966 Hershman ..... A47D 13/025 224/160
3,871,562 A * 3/1975 Grenier ..... A47D 13/025 224/160
4,009,808 A * 3/1977 Sharp ..... A47D 13/025 224/160
4,166,558 A * 9/1979 Schroeder ..... A47D 13/025 224/158
4,389,005 A * 6/1983 Cable ..... A47D 13/025 224/159
4,428,514 A * 1/1984 Elf ..... A47D 13/025 224/155
4,434,920 A * 3/1984 Moore ..... A47D 13/025 224/160
4,436,233 A * 3/1984 Hill ..... A47D 13/025 224/159
4,458,834 A * 7/1984 Rosen ..... A47D 13/025 224/159
4,467,945 A * 8/1984 Schaapveld ..... A47D 13/025 224/160
4,492,326 A * 1/1985 Storm ..... A47D 13/025 224/159

(Continued)

*Primary Examiner* — Nathan J Newhouse
*Assistant Examiner* — Phillip Schmidt
(74) *Attorney, Agent, or Firm* — Stetina Brunda Garred & Brucker

(57) ABSTRACT

An infant carrier which provides the comfort of a wrap-type carrier and the ease of use of a conventional soft-sided infant carrier. The infant carrier includes a pair of adjustable side panels which allow a wearer to selectively transition the side panels between narrow and wide seat configurations to accommodate the size of the infant seated within the carrier. The carrier also includes a torso band, which enables adjustment of the infant support panel relative to the wearer, and also rests higher than conventional waist belts commonly employed on most soft-sided infant carriers.

17 Claims, 4 Drawing Sheets

(56) References Cited

U.S. PATENT DOCUMENTS 4,579,264 A * 4/1986 Napolitano ..... A47D 13/025 224/158
4,915,277 A * 4/1990 Larreategui ..... A47D 13/025 224/158
5,205,450 A * 4/1993 Derosier ..... A47D 13/025 224/161
5,205,451 A * 4/1993 Manzer ..... A47D 13/025 224/161
5,678,739 A * 10/1997 Darling ..... A47D 13/025 224/158
5,692,655 A * 12/1997 Fair ..... A47D 13/025 224/160
5,791,535 A * 8/1998 Roan ..... A47D 13/025 224/153
5,813,580 A * 9/1998 Fair ..... A47D 13/025 224/160
5,848,741 A * 12/1998 Fair ..... A47C 7/66 224/160
5,927,576 A * 7/1999 Nielsen ..... A47D 13/025 224/160
6,409,060 B2 * 6/2002 Donine ..... A47D 13/025 224/160
6,415,969 B1 * 7/2002 Higuchi ..... A47D 13/025 224/159
6,666,361 B1 * 12/2003 Lin ..... A45F 3/02 224/160
D615,749 S * 5/2010 Wagner ..... D3/213
7,766,199 B1 * 8/2010 Caperon ..... A47D 13/025 224/158
8,056,779 B1 * 11/2011 Brunwin ..... A47D 13/025 224/160
8,172,116 B1 * 5/2012 Lehan ..... A45F 3/04 224/159
8,701,949 B1 * 4/2014 Lehan ..... A45F 3/047 224/160
2002/0130148 A1 * 9/2002 Le Gal ..... A47D 13/025 224/160
2002/0158094 A1 * 10/2002 Yen ..... A47D 13/025 224/159
2002/0175194 A1 * 11/2002 Norman ..... A47D 13/025 224/160
2004/0238579 A1 * 12/2004 Krogh ..... A47D 13/025 224/160
2004/0245298 A1 * 12/2004 Refsum ..... A41B 13/00 224/159
2005/0045674 A1 * 3/2005 Rehbein ..... A47D 13/025 224/160
2005/0051582 A1 * 3/2005 Frost ..... A47D 13/025 224/160
2005/0155995 A1 * 7/2005 Lee ..... A47D 13/025 224/160
2005/0184114 A1 * 8/2005 Hoff ..... A47D 13/025 224/160
2005/0242136 A1 * 11/2005 Moriguchi ..... A47D 13/025 224/160
2005/0258202 A1 * 11/2005 Stevens ..... A47D 13/025 224/159
2005/0279785 A1 * 12/2005 Liistro ..... A47D 13/025 224/160
2006/0076373 A1 * 4/2006 LaBelle ..... A45F 3/04 224/160
2006/0130220 A1 * 6/2006 Morgan ..... A41B 13/00 2/456
2006/0261104 A1 * 11/2006 Zambrzycki ..... A47D 13/025 224/158
2007/0138218 A1 * 6/2007 Calilung ..... A47D 13/025 224/160
2007/0175934 A1 * 8/2007 Boal ..... A47D 13/025 224/159
2007/0199125 A1 * 8/2007 Dellanno ..... A61F 5/026 2/69
2007/0283480 A1 * 12/2007 Harris ..... A41B 13/005 2/80
2007/0284403 A1 * 12/2007 Minami ..... A47D 13/02 224/160
2008/0190972 A1 * 8/2008 Gray ..... A47D 15/006 224/160
2008/0283559 A1 * 11/2008 Parness ..... A47D 13/025 224/159
2008/0283561 A1 * 11/2008 Parness ..... A47D 13/025 224/160
2008/0314940 A1 * 12/2008 Cohen Raz ..... A47D 13/025 224/161
2009/0026235 A1 * 1/2009 Gray ..... A47D 15/006 224/160
2009/0032558 A1 * 2/2009 Klein, II ..... A47D 13/025 224/161
2009/0078729 A1 * 3/2009 Coote ..... A47D 15/006 224/161
2009/0101683 A1 * 4/2009 Gilboa ..... A47D 13/025 224/160
2009/0206116 A1 * 8/2009 Grant ..... A45F 3/08 224/160
2009/0302075 A1 * 12/2009 Trainer ..... A47D 13/025 224/160
2010/0072236 A1 * 3/2010 Parness ..... A47D 13/025 224/161
2010/0147910 A1 * 6/2010 Schachtner ..... A47D 13/025 224/160
2010/0155446 A1 * 6/2010 Stein ..... A47D 13/025 224/576
2010/0187269 A1 * 7/2010 Leistensnider ..... A47D 13/025 224/159
2010/0200626 A1 * 8/2010 Moftakhar ..... A47D 13/025 224/160
2010/0308088 A1 * 12/2010 Lindblom ..... A47D 13/025 224/160
2011/0089205 A1 * 4/2011 Coote ..... A47D 13/025 224/160
2011/0101051 A1 * 5/2011 Parness ..... A47D 13/02 224/160
2011/0163136 A1 * 7/2011 Billingham ..... A47D 13/025 224/160
2011/0174845 A1 * 7/2011 LaBelle ..... A47D 13/025 224/160
2011/0186605 A1 * 8/2011 Favorito ..... A47D 13/025 224/160
2011/0240693 A1 * 10/2011 Parness ..... A47D 13/025 224/160
2011/0290831 A1 * 12/2011 Wang ..... A47D 13/025 224/160
2012/0012623 A1 * 1/2012 Bergkvist ..... A44B 11/28 224/158
2012/0043359 A1 * 2/2012 Bergkvist ..... A47D 13/025 224/160
2012/0061429 A1 * 3/2012 Sauer ..... A47D 13/025 224/160
2012/0187161 A1 * 7/2012 Bergkvist ..... A47D 13/025 224/160
2012/0187162 A1 * 7/2012 Bergkvist ..... A47D 13/025 224/160
2012/0205406 A1 * 8/2012 Schachtner ..... A47D 13/025 224/160
2012/0217273 A1 * 8/2012 Gunter ..... A47D 13/025 224/160
2012/0241487 A1 * 9/2012 Zack ..... A47D 13/025 224/576
2012/0286002 A1 * 11/2012 Dardel ..... A47D 13/025 224/159
2012/0298702 A1 * 11/2012 Jung ..... A47D 13/025 224/158
2012/0318833 A1 * 12/2012 Zack ..... A47D 13/025 224/160
2013/0327796 A1 * 12/2013 Poiani ..... A47D 13/02 224/160
2014/0014692 A1 * 1/2014 Andren ..... A47D 13/025 224/161

(56) References Cited

U.S. PATENT DOCUMENTS

| | | | | |
|---|---|---|---|---|
| 2014/0084031 | A1* | 3/2014 | Bowden | A47D 13/025 224/158 |
| 2014/0084037 | A1* | 3/2014 | Hartwell | A47D 13/025 224/581 |
| 2014/0097215 | A1* | 4/2014 | Caperon | A47D 13/025 224/160 |
| 2014/0131401 | A1* | 5/2014 | Workman | A47D 13/025 224/160 |
| 2014/0166705 | A1* | 6/2014 | Vukovics | A47D 13/025 224/158 |
| 2014/0231472 | A1* | 8/2014 | Cha | A47D 13/025 224/160 |
| 2014/0263491 | A1* | 9/2014 | Telford | A47D 13/025 224/160 |
| 2014/0263492 | A1* | 9/2014 | Bailey | A47D 13/025 224/160 |
| 2014/0284361 | A1* | 9/2014 | Wang | A47D 13/025 224/159 |
| 2014/0284362 | A1* | 9/2014 | Halverstadt | A47D 13/02 224/159 |
| 2014/0319189 | A1* | 10/2014 | Hoppener-Visser | A47D 13/025 224/160 |
| 2015/0201761 | A1* | 7/2015 | Wollenberg | A47D 13/025 224/576 |
| 2015/0282638 | A1* | 10/2015 | Workman | A47D 13/025 224/160 |
| 2015/0282639 | A1* | 10/2015 | Chuah | A47D 13/025 224/160 |
| 2015/0359356 | A1* | 12/2015 | Beekman | A47D 15/00 224/576 |
| 2015/0374139 | A1* | 12/2015 | Salazar | A47D 13/025 224/160 |

* cited by examiner

INFANT CARRIER WITH ADJUSTABLE SIDE PANELS AND TORSO BAND

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

1. Technical Field of the Invention

The present disclosure generally relates to an infant carrier, and more specifically to a shoulder-strap style infant carrier having selectively adjustable side panels for adjusting the width of the seat portion, and a torso band which mimics the feel of a wrap-style carrier to gently hold the infant against the wearer's chest.

2. Description of the Related Art

It is common practice for parents and other caregivers to carry infants and toddlers, and there are a variety of well-known devices suitable to this end. Such infant-carrying devices include carriages, strollers, pushchairs, and car seats, which are separate units particularly configured for holding the infant or toddler independent of the parent/caregiver adult. The adult, in turn, holds and transports the device with handles and other attachments thereof.

Alternatively, there are devices known in the art configured to be worn by the adult for on-the-body carrying of the infant or toddler, including slings, wraps, pouches, and backpack-like shoulder strap devices. Shoulder-supported infant carriers are particularly growing in popularity for supporting or transporting an infant or young child. A common attribute of these carriers is that they typically offer "hands free" operation, and allow the adult wearer to carry the infant while performing other activities. Therefore, shoulder-supported infant carriers typically provide immediate benefits to the parent/caregiver, including the freedom to use both hands while monitoring and caring for the child being carried. Care may be provided to other children simultaneously, strain and fatigue on the arms, back, and shoulders may be reduced, and household chores may be completed while monitoring the child. Moreover, cumbersome and bulky strollers need not be deployed in potentially dangerous places, such as crowded city sidewalks and public transportation systems.

Shoulder supported infant carriers, as currently known in the art, come in a wide range of designs and styles. One currently known infant carrier is a frame-type carrier which typically supports the infant on the back of the wearer. Currently, more popular than frame-type carriers, are frameless or soft-sided carriers which typically provide more comfort to the wearer and the infant.

Although soft-sided carriers have become a popular means for transporting an infant, most soft-sided carriers suffer from one or more drawbacks. For instance, one common drawback associated with conventional soft-sided carriers is that soft-sided carriers generally include a seat portion that is of a fixed size. Therefore, as the infant grows, the seat portion of the carrier may become too small, or when the infant is young, the seat portion of the carrier may be configured to support a larger infant, and thus, may be too big. Furthermore, the fixed nature of the seat portion on conventional infant carriers may limit the adaptability achievable by the infant carriers, i.e., the infant carrier may not be easily or comfortably adaptable in both front carry and rear carry configurations.

Another popular style of infant carrier which typically has more adaptability than conventional soft-sided carriers are wrap-style carriers. Due to the frame-less nature and soft, flexible fabric material used in forming most wrap-style carriers, many wrap-style carriers tend to conform to the shape and size of the wearer and the infant to provide a comfortable fit. The wrap-style carrier may also be adjusted to "hug" the infant against the wearer.

The benefits of most wrap-style carriers are also balanced by various drawbacks. In particular, the increased adaptability afforded by wrap-style carriers oftentimes also creates difficulty in placing the wrap-style carrier on the wearer, and securing the infant within the wrap-style carrier.

Accordingly, there is a need in the art for an infant carrier which offers the benefits of conventional soft-sided carriers and wrap-style carriers, without the drawbacks associated with such carriers. Various aspects of the present invention are directed toward addressing these needs, as will be discussed in more detail below.

BRIEF SUMMARY OF THE INVENTION

Various aspects of the present invention are directed toward an infant carrier which provides the comfort of a wrap-type carrier and the ease of use of a conventional soft-sided infant carrier. The infant carrier includes a pair of adjustable side panels which allow a wearer to selectively transition the side panels between narrow and wide configurations for adjusting the size of the seat of the infant carrier. The carrier also includes a torso band having fabric panels which conform to the shape of the wearer and gently "hugs" the infant seated in the carrier, which mimics the feel of a wrap-style carrier.

According to one embodiment, there is provided an adjustable infant carrier wearable by a user for carrying an infant. The infant carrier includes a pair of shoulder straps and a central panel coupled to the pair of shoulder straps. The central panel includes a pair of opposed lateral portions, an infant torso support portion, and an infant bottom support portion. A pair of adjustable side panels are coupled to respective ones of the pair of lateral portions of the central panel and extend along the infant torso support portion and the infant bottom support section. Each side panel includes a respective lateral edge and is selectively adjustable relative to the central panel between a narrow configuration and a wide configuration. The distance between the lateral edge and the central panel increases as the side panel transitions from the narrow configuration toward the wide configuration. A torso band is connected to the central panel and is configured to extend over the infant's legs when the infant is seated within the carrier.

Each adjustable side panel may include a plurality of pleats to enable transition between the narrow configuration and the wide configuration. Each adjustable side panel may overlap a respective portion of the torso band, wherein the degree of overlap increases as the respective side panel transitions from the narrow configuration toward the wide configuration.

The torso band may be comprised of a first material portion and a second material portion, wherein the second material portion is formed from a material that differs from the first material portion. The first material portion of the torso band may be formed of the same material as the central panel. The torso band may include a pair of cooperatively engageable buckles.

The adjustable infant carrier may additionally include a back support panel extending between the pair of shoulder straps and spaced from the central panel.

An infant head support panel may be coupled to the central panel and transitional relative thereto between an extended configuration and a folded configuration.

The infant carrier may be adapted to selectively carry an infant in an outward facing direction or an opposing inward facing direction.

The presently contemplated embodiments will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION OF THE INVENTION

Figure 1:
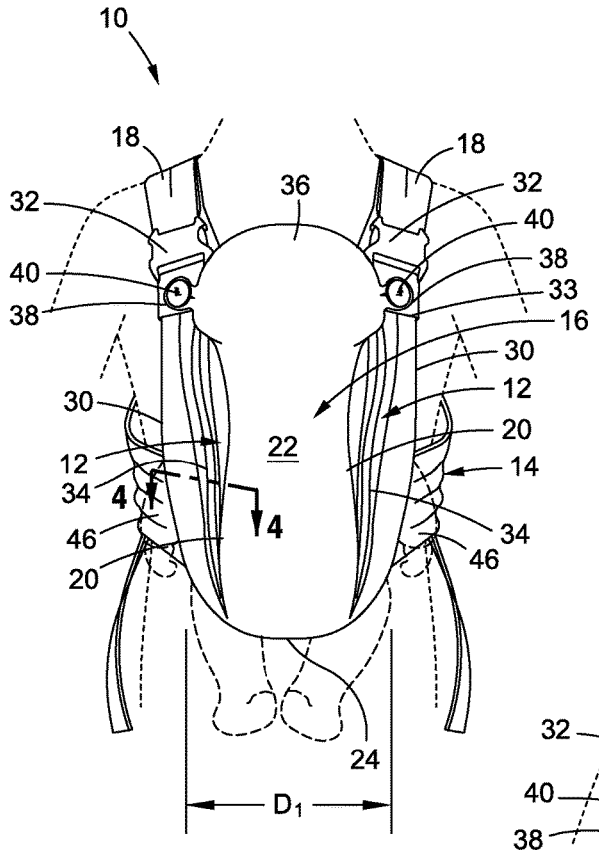
FIG. 1 is a front view of an infant carrier constructed in accordance with an embodiment of the present invention, the infant carrier being in a narrow configuration.

Referring now to the drawings, wherein the showings are for purposes of illustrating a preferred embodiment of the present invention only, and are not for purposes of limiting the same, there is depicted an infant carrier 10 specifically configured and adapted to combine the ease-of-use of a conventional shoulder-strap soft-style carrier, as well as the comfort and adaptability of a conventional wrap-type infant carrier. This dual-benefit is primarily attributable to three unique features of the infant carrier 10: (1) expandable side panels 12, (2) a torso band 14, and (3) shoulder straps 18. The expandable side panels 12 can be selectively transitioned between narrow and wide configurations to adjust the size of the seat to accommodate both large and small infants, similar to conventional wrap-type infant carriers. The torso band 14 is formed of a soft material which conforms to the shape of the wearer is configured to be adjustable to allow the infant to be pulled closer to the wearer to provide a more secure feel for the infant positioned within the carrier 10, which simulates the feel of conventional wrap-type carriers. The shoulder straps 18 are specifically adapted to enable quick and easy placement of the infant carrier 10 on the wearer, as well as placement of the infant within the carrier 10. By incorporating these features into a single infant carrier 10, the infant carrier 10 offers the benefits of both soft-sided carriers as well as wrap-style carriers, without suffering from the deficiencies commonly associated therewith.

In addition to the side panels 12, torso band 14, and shoulder straps 18, the infant carrier 10 includes a central panel 16, which includes opposed lateral portions 20, an infant torso support portion 22, and an infant bottom support portion 24. When the infant carrier 10 is worn, the central panel 16 is in generally opposed relation to the wearer, typically in front of the wearer's chest. The opposed lateral portions 20 may have seams defining terminal ends thereof, wherein the seam connects the central panel 16 to respective ones of the side panels 12, as will be described in more detail below. The infant torso support portion 22 is adapted to support the torso of the infant (e.g., the infant's chest or back), while the infant bottom support portion 24 is connected to the shoulder straps 18 and extends under the infant between the infants legs to support the buttocks of the infant. The bottom support portion 24 further extends upwardly along the infant's lower back if the infant is facing inward toward the wearer, or over the infant's lower stomach if the infant is facing outward, away from the wearer.

The adjustable side panels 12 are coupled to the central panel 16 at respective ones of the lateral side portions 20 thereof, and extend laterally outward from the central panel 16. Each side panel 12 extends along the infant bottom support portion 24 as well as the infant torso support portion 22 of the central panel 16. In one embodiment, each side panel 12 is sewn to the central panel 16 using conventional stitching techniques known in the art. In the exemplary embodiment, and referring specifically to FIG. 3, each adjustable side panel 12 is coupled to the central panel 16 to define a substantially linear seam 26. Each adjustable side panel 12 further includes an arcuate upper edge 28 which extends outwardly relative to the central panel 16. A lateral edge 30 extends from the central panel 16 at a lower end portion thereof to the arcuate upper edge 28 at an upper end portion thereof.

Although the foregoing describes the side panels 12 as being coupled to the central panel 16 via a stitched seam 26, it is also contemplated that the side panels 12 may be coupled to the central panel 16 using other known fastening means. For instance, the side panels 12 may be coupled to the central panel 16 via hook and loop fasteners (e.g., VELCRO), buttons, snaps, or the like. It is additionally contemplated that the central panel 16 and the side panels 12 may be formed from a common piece of fabric and collectively define a continuous surface with no seams or edges located between the central panel 16 and the side panels 12.

Figure 3:
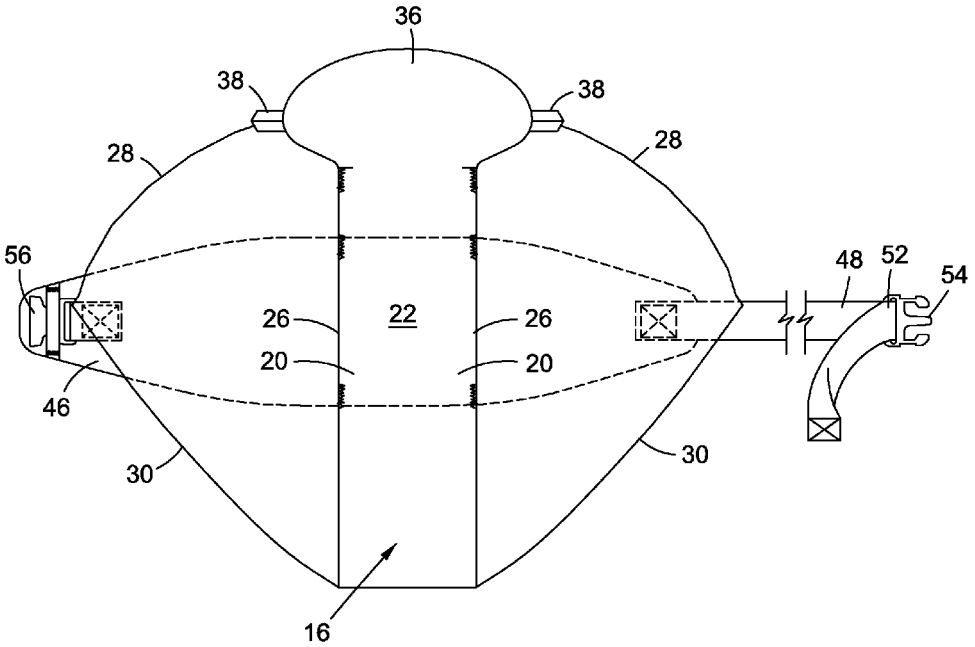
FIG. 3 is a plan view of a portion of the infant carrier, depicting with particularity a central panel, a pair of side panels, and a torso band thereof, wherein the side panels are shown prior to having pleats formed therein.

As noted above, each side panel 12 is selectively transitional between a narrow configuration and a wide configuration. According to one embodiment, such transition is made possible by forming a plurality of pleats 34 within each side panel 12. The pleats 34 allow for an accordion-style extension and retraction of the side panels 12, as desired by the user. The folds of the pleats 34 extend in a generally longitudinal direction (e.g., parallel to the medial edge of the side panel) and are sewn at the top to fix one end of the pleats 34. As shown in FIG. 1, the pleats 34 are created by gathering the upper edge 28 as shown in FIG. 3 and permanently sewing them together along seam 33, thereby restricting expansion of the side panels 12 along seam 33. When the side panel 12 is transitioned between the narrow and wide configurations, the side panel 12 is adjusted in a direction that is generally perpendicular to the direction of the folds.

Figure 4:
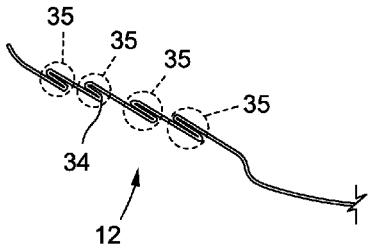
FIG. 4 is a partial sectional view of a side panel taken from the infant carrier depicted in FIG. 1, wherein the side panel includes a plurality of overlapping sections resulting from the infant carrier being in the narrow configuration.
Figure 5:
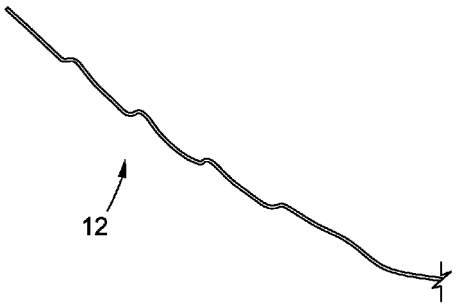
FIG. 5 is a partial sectional view of the side panel taken from the infant carrier depicted in FIG. 2, wherein the degree of overlap relative to the configuration depicted in FIG. 4 is less by virtue of the infant carrier being in the wide configuration.

The formation of the pleats 34 within the side panels 12 results in overlapping portions 35 of the side panels 12, as can be seen in FIG. 4. The pleats 34 allow portions of the side panel 12 to be folded on top of each other when the infant carrier 10 is in the narrow configuration. As the side panel 12 transitions from the narrow configuration toward the wide configuration, the degree of overlapping portions 35 within the side panels 12 decreases. The decrease in overlapping portions 35 occurs because one end of the side panel 12 is pulled away from the central panel 12, which extends the side panel 12. Conversely, as the side panel 12 transitions from the wide configuration toward the narrow configuration, the degree of overlap within the side panel 12 increases. The change in the degree of overlap can be illustrated by comparing the overlapping portions 35 shown in FIG. 4, which is a cross-section taken through a side panel 12 in the narrow configuration, whereas FIG. 5 shows a cross-section taken through a side panel 12 in the wide configuration. As can be seen, the overlapping portions 35 are essentially absent from the side panel 12 in FIG. 5, since the side panel 12 has been extended to the wide configuration.

Figure 2:
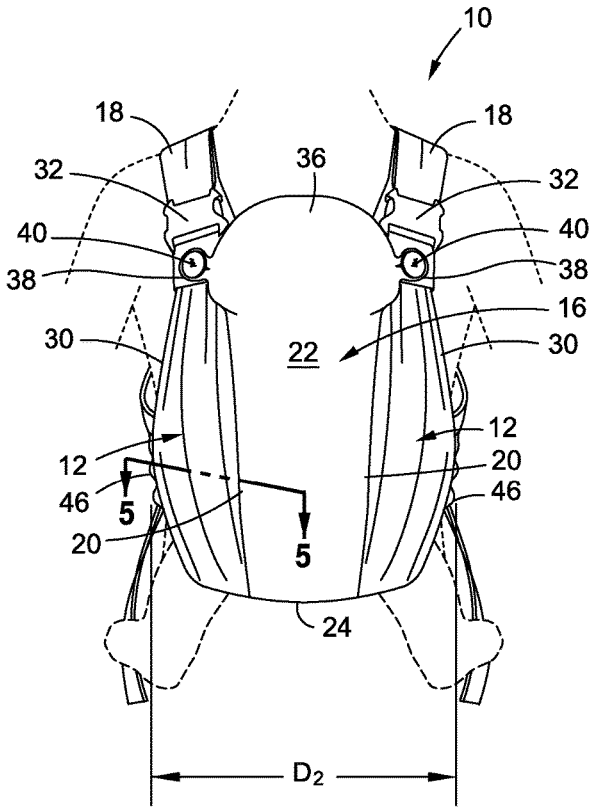
FIG. 2 is a front view of the infant carrier shown in FIG. 1 in a wide configuration.

Transitioning of the side panels 12 between the wide and narrow configurations also causes lateral edges 30 of the respective side panels 12 to be moved relative to the central panel 16. In particular, as the side panels 12 move from the narrow configuration toward the wide configuration, the lateral edge 30 of each side panel 12 moves away from the central panel 12. Furthermore, as the side panels 12 move from the wide configuration toward the narrow configuration, the lateral edges 30 of each side panel 12 move closer to the central panel 12. In FIG. 1, the side panels 12 are both in the narrow configuration, which results in the bottom of the lateral edges 30 being spaced apart from each other by a first distance, $D_1$. FIG. 2 shows both side panels 12 in the wide configuration, which results in the bottom of the lateral edges 30 being spaced apart from each other by a second distance, $D_2$, which is larger than the first distance $D_1$.

The side panels 12 advantageously mimic the comforting wrap-style feel on the infant by wrapping around both sides of the infant. The side panels 12 also allow the infant carrier 10 to adapt to the size of the infant seated within the carrier 10, in addition to adapting to the position of the infant within the carrier 10. For instance, for infants facing toward the wearer, larger infants tend to require a larger seat than smaller infants, and thus, the side panels 12 may be transitioned to the wide configuration to accommodate larger infants, and the narrow configuration to accommodate smaller infants. Furthermore, if the infant is facing out, looking away from the wearer, it may be desirable to place the side panels 12 in the narrow configuration.

An upper lateral portion of each side panel 12 is selectively attachable to respective ones of the shoulder straps 18. A buckle-type connector 32 including a male buckle portion and a corresponding female buckle portion may be employed for selectively coupling the side panels 12 to the shoulder straps 18. One or both of the connectors 32 may be detached when placing the infant within the carrier 10. Once the infant is seated within the carrier 10, the connectors 32 may be attached as shown in FIGS. 1 and 2.

The infant carrier 10 further includes a head panel 36 which may be selectively employed for supporting the infant's head when the infant is facing the wearer. The head panel 36 may be a continuous extension of the central panel 16 at an upper end portion thereof (i.e., above the infant torso support portion 22). In the exemplary embodiment, the head panel 36 is unitarily formed with the central panel 16 (e.g., formed from a common piece of fabric). Alternatively, the head panel 36 may be formed from separate pieces of material.

Figure 8:
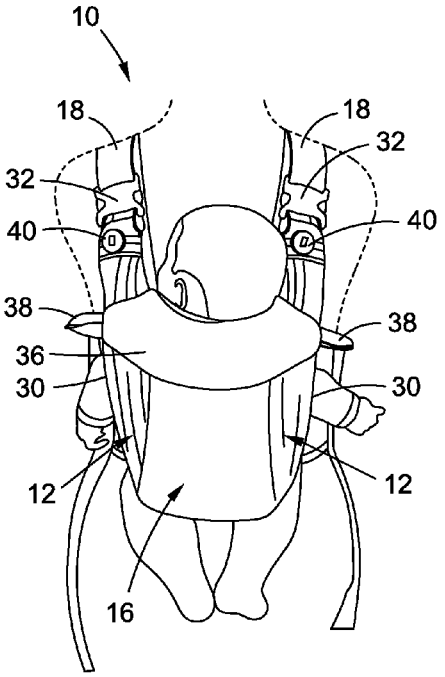
FIG. 8 is a front view of the infant carrier in a narrow configuration, with an infant facing toward the wearer.
Figure 9:
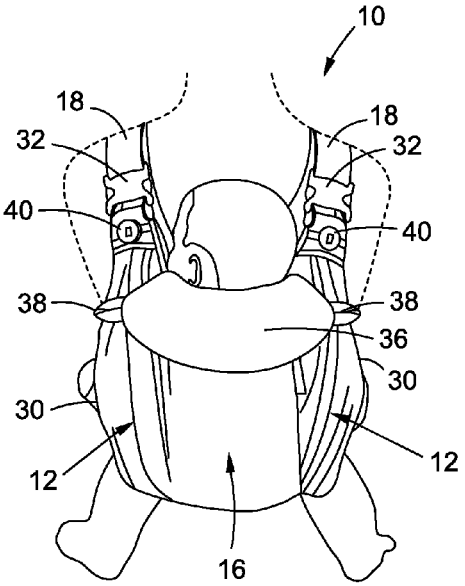
FIG. 9 is a front view of the infant carrier in a wide configuration, with an infant facing toward the wearer.
Figure 10:
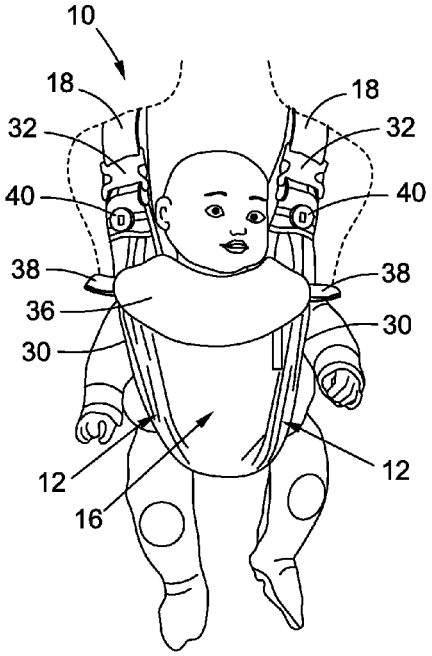
FIG. 10 is a front view of the infant carrier in a narrow configuration, with an infant facing away from the wearer.

The head panel 36 is adapted to be selectively transitioned between an extended/supporting configuration (see FIGS. 1-2) and a folded configuration (see FIGS. 8-10). In the extended configuration, the head panel 36 does not overlap with the central panel 16, and extends behind the infant's head to provide support thereto. The head panel 36 may be maintained in the extended configuration through use of first lateral attachment members 38, which are selectively engageable with corresponding second lateral attachment members 40, which may be located on the side panels 12 or shoulder straps 18. In order to transition the head panel 36 from the extended configuration toward the folded configuration, the first lateral attachment members 38 are disconnected from the second lateral attachment members 40, which allows the head panel 36 to be folded over the central panel 16. It may be desirable to fold the head panel 36 when the infant can support its own head, wherein the folded head panel 36 would allow for a greater range of motion. Furthermore, the folded head panel 36 may be used when the infant is facing out, away from the wearer.

Figure 6:
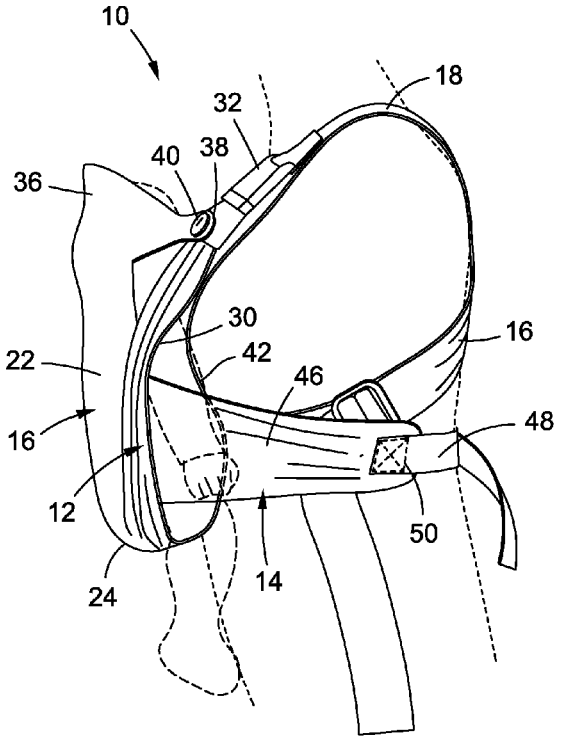
FIG. 6 is a side view of the infant carrier.

The shoulder straps 18 extend over respective ones of the wearer's shoulders for supporting the infant carrier 10 on the wearer. The shoulder straps 18 may connect to a lower end of the central panel 16, or alternatively, the infant carrier 10 may include a connecting panel 42 (see FIG. 6), which connects the central panel 16 to the shoulder straps 18 and resides between the infant and the wearer during use. The shoulder straps 18 may be configured to enable selective adjustment of the size thereof to fit the shoulder straps 18 to the wearer.

Figure 7:
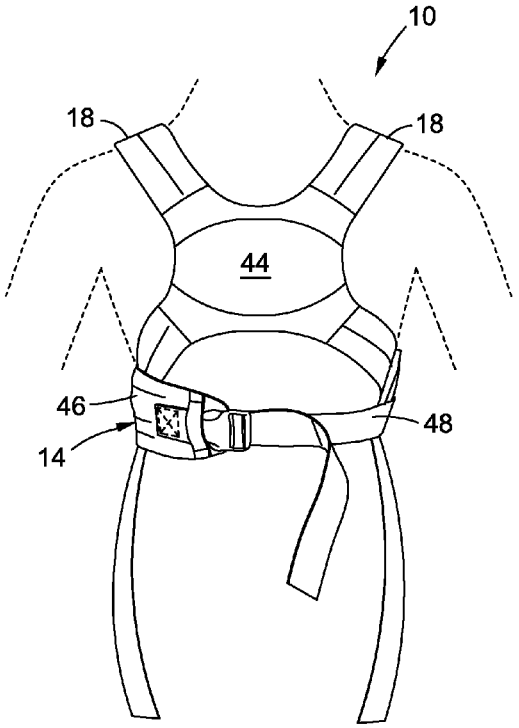
FIG. 7 is a rear view of the infant carrier.

Referring now specifically to FIG. 7, the shoulder straps 18 may converge at a back support panel 44 to evenly distribute the load supported by the shoulder straps 18. The rigid connection between the shoulder straps 18 and the back support panel 44 may also maintain the shoulder straps 18 in place during use.

In addition to shoulder straps 18, at least one embodiment of the infant carrier 10 includes the aforementioned torso band 14 to enhance the support and comfort of the carrier 10. The torso band 14 includes a pair of fabric panels 46 interconnected by a strap portion 48. The fabric panels 46 may be formed from a comfortable, flexible fabric, such as cotton, while the strap portion 48 may be formed from a strong, durable fabric, such as woven nylon, although other materials known in the art may also be used.

The fabric panels 46 are connected to the central panel 16 at respective lateral portions thereof 20. The fabric panels 46 are typically wider than the strap portion 48, which allow the fabric panels 46 to "hug" the wearer to mimic the feel of a wrap-style carrier on the user. The fabric panels 46 also dissipate the force applied to the wearer from the torso band 14 so as to provide a more comfortable fit. The strap portion 48 includes a first end portion 50 (see FIG. 6) coupled to one of the fabric panels 46, and a second end portion 52 coupled to a first buckle 54. The first buckle 54 is adapted to cooperatively engage with a second buckle 56 coupled to the other one of the fabric panels 46.

The strap portion 48 is adjustably coupled to the first buckle 54 to allow for adjustment of the torso band 14 to fit the size of the wearer and the infant seated within the carrier 10. The attachment of the fabric panels 46 to the central panel 16 allows for adjustment of the central panel 16 through adjustment of the torso band 14. More specifically, the central panel 16 may be moved closer to the wearer by tightening the torso band 14, and conversely, the central panel 16 may be moved farther away from the wearer by loosening the torso band 14. The adjustment of the central panel 16 allows the wearer to find the most comfortable fit and sense of security for both the wearer and the infant.

The torso band 14 differs from conventional waist bands due to the location of the torso band 14 on the infant carrier 10. In particular, the torso band 14 is generally higher on the infant carrier 10 than conventional waist bands, which are typically located at the bottom of the infant carrier, and in some cases, are spaced from the panels supporting the infant. In this respect, waist belts on conventional infant carriers typically do not allow for adjustment of tightness of the carrier on the infant.

The higher placement of the torso band 14 on the carrier 10 also results in the torso band 14 extending over the infant's legs when the infant is seated within the carrier 10. The placement of the torso band 14 over the infant's legs further enhances the security of the infant when placed within the carrier 10.

The location of the torso band 14 and side panels 12 results in an overlap between the side panels 12 and the torso band 14. In particular, the degree of overlap therebetween increases as the side panels 12 transition from the narrow configuration toward the wide configuration. Conversely, the degree of overlap decreases as the side panels 12 transition from the wide configuration toward the narrow configuration.

The infant carrier 10 is designed to be worn in one of several different configurations. FIG. 1 shows the infant carrier in an inward-facing narrow configuration, wherein the infant faces toward the wearer and the side panels 12 are in the narrow configuration. Furthermore, the head panel 36 is in the extended position to provide support to the infant. FIG. 8 shows the infant carrier 10 in an inward-facing narrow configuration with the head panel 36 in the folded configuration. In this respect, the head panel 36 may be folded down as shown in FIG. 8 when the infant/child has sufficient strength to support its head.

FIG. 2 shows the infant carrier 10 in an inward-facing, wide configuration and the head panel 36 in an extended configuration, while FIG. 9 shows the infant carrier 10 in an inward-facing, wide configuration, with the head panel 36 in a folded configuration.

FIG. 10 shows the infant carrier 10 in an outward-facing configuration, wherein the side panels 12 are in the narrow configuration to accommodate the infant's legs and the head panel 36 is in the folded configuration so as not to block the line of sight for the infant.

Although the embodiment of the carrier 10 depicted in the Figures is adapted to be worn over the wearer's chest, it is also contemplated that other embodiments of the carrier 10 may be adapted to be worn over the wearer's back. In such back-carry embodiments, the shoulder straps may include a chest/back strap to enable the carrier 10 to be worn safely on the wearer's back. In this respect, the scope of the present disclosure is broad enough to encompass both front-carry and back-carry configurations.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. An adjustable infant carrier wearable by a user for carrying an infant, the infant carrier comprising:

a pair of shoulder straps;

a central panel coupled to the pair of shoulder straps and having an infant torso support portion and an infant bottom support portion;

a pair of adjustable side panels coupled to respective lateral portions of the central panel, each of the side panels extending along the infant torso support portion and the infant bottom support portion, each side panel having an upper edge that is affixed to the central panel, and a lateral edge which extends from the upper edge and is sized to extend beyond a corresponding shoulder of the infant when the infant is carried in the infant carrier, each of the side panels being releasably attachable to a respective one of the shoulder straps and adjustable relative to the central panel between a narrow configuration and a wide configuration, wherein the distance between the lateral edge and the central panel increases as the side panel transitions from the narrow configuration toward the wide configuration, each side panel further including a plurality of pleats which facilitate the formation of overlapping portions having corresponding degrees of overlap when the side panel is in the narrow configuration, the degrees of overlap decreasing as the side panel transitions from the narrow configuration toward the wide configuration; and a torso band connected to the central panel and configured to extend over the infant's legs to capture the infant's legs between the torso band and the user when the infant is seated within the carrier.

2. The adjustable infant carrier recited in claim 1, wherein each side panel overlaps a respective portion of the torso band, the degree of overlap increasing as the respective side panel transitions from the narrow configuration toward the wide configuration.

3. The adjustable infant carrier recited in claim 1, wherein the torso band is comprised of a first material portion and a second material portion, wherein the second material portion is formed from a material that differs from the first material portion.

4. The adjustable infant carrier recited in claim 3, wherein the first material portion of the torso band is formed of the same material as the central panel.

5. The adjustable infant carrier recited in claim 1, wherein the torso band includes a pair of cooperatively engageable buckles.

6. The adjustable infant carrier recited in claim 1, further comprising a back support panel extending between the pair of shoulder straps and spaced from the central panel.

7. The adjustable infant carrier recited in claim 1, further comprising an infant head support panel coupled to the central panel.

8. The adjustable infant carrier recited in claim 7, wherein the infant head support panel is transitional relative to the central panel between an extended configuration and a folded configuration.

9. The adjustable infant carrier recited in claim 1, wherein the infant carrier is adapted to selectively carry an infant in an outward facing direction and an opposing inward facing direction.

10. The adjustable infant carrier recited in claim 1, further comprising a pair of buckles, each of the buckles having a first portion connected to a respective one of the shoulder straps and a second portion selectively engageable with the first portion and connected to a respective one of the pair of adjustable side panels, the lateral edge of each of the adjustable side panels extending from the second portion of a corresponding one of the pair of buckles.

11. An adjustable infant carrier wearable by a user for carrying an infant, the infant carrier comprising:

a pair of shoulder straps;

a central panel coupled to the pair of shoulder straps and having an infant torso support portion and an infant bottom support portion; and a pair of adjustable side panels coupled to respective lateral portions of the central panel, each of the side panels extending along the infant torso support portion and the infant bottom support portion from one of the shoulder straps to the infant bottom support portion, each side panel having an upper edge that is affixed to the central panel, and a lateral edge which extends from the upper edge and is sized to extend beyond a corresponding shoulder of the infant when the infant is carried in the infant carrier, each of the side panels being releasably attachable to a respective one of the shoulder straps and adjustable relative to the central panel between a narrow configuration and a wide configuration, wherein the distance between the lateral edge and the central panel increases as the side panel transitions from the narrow configuration toward the wide configuration, each side panel further including a plurality of pleats which facilitate the formation of overlapping portions having corresponding degrees of overlap when the side panel is in the narrow configuration, the degree of overlap decreasing as the side panel transitions from the narrow configuration toward the wide configuration.

12. The adjustable infant carrier recited in claim 11, wherein the pair of adjustable side panels are formed from the same material as the central panel.

13. The adjustable infant carrier recited in claim 11, wherein the pair of adjustable side panels and the central panel collectively define a continuous surface extending between the respective lateral edges of the pair of adjustable side panels.

14. The adjustable infant carrier recited in claim 11, further comprising a pair of buckles, each of the buckles having a first portion connected to a respective one the shoulder straps and a second portion selectively engageable with the first portion and connected to a respective one of the pair of adjustable side panels, the lateral edge of each of the adjustable side panels extending from the second portion of a corresponding one of the pair of buckles.

15. An adjustable infant carrier wearable by a user for carrying an infant, the infant carrier comprising:

a pair of shoulder straps;

a central panel coupled to the pair of shoulder straps and having an infant torso support portion and an infant bottom support portion;

a pair of adjustable side panels coupled to respective lateral portions of the central panel, each of the side panels:

extending along the infant torso support portion and the infant bottom support portion from one of the shoulder straps to the infant bottom support portion;

including an upper edge affixed to the central panel;

being releasably attached to a respective one of the shoulder straps;

having a respective lateral edge and being adjustable relative to the central panel between a narrow configuration and a wide configuration, wherein the distance between the lateral edge and the central panel increases as the side panel transitions from the narrow configuration toward the wide configuration; and including a plurality of pleats which facilitate the formation of overlapping portions having corresponding degrees of overlap when the side panel is in the narrow configuration, the degrees of overlap decreasing as the side panel transitions from the narrow configuration toward the wide configuration; and a torso band connected to the central panel and configured to extend over the infant's legs to capture the infant's legs between the torso band and the user when the infant is seated within the carrier.

16. An adjustable infant carrier wearable by a user for carrying an infant, the infant carrier comprising:

a pair of shoulder straps;

a central panel coupled to the pair of shoulder straps and having an infant torso support portion and an infant bottom support portion;

a pair of adjustable side panels coupled to respective lateral portions of the central panel, each of the side panels extending along the infant torso support portion and the infant bottom support portion, each side panel having a respective lateral edge sized to extend beyond a corresponding shoulder of the infant when the infant is carried in the infant carrier and being adjustable relative to the central panel between a narrow configuration and a wide configuration, wherein the distance between the lateral edge and the central panel increases as the side panel transitions from the narrow configuration toward the wide configuration, each side panel further including a plurality of pleats which facilitate the formation of overlapping portions having corresponding degrees of overlap when the side panel is in the narrow configuration, the degrees of overlap decreasing as the side panel transitions from the narrow configuration toward the wide configuration;

a torso band connected to the central panel and configured to extend over the infant's legs to capture the infant's legs between the torso band and the user when the infant is seated within the carrier; and a pair of buckles, each of the buckles having a first portion connected to a respective one of the shoulder straps and a second portion selectively engageable with the first portion and connected to a respective one of the pair of adjustable side panels, the lateral edge of each of the adjustable side panels extending from the second portion of a corresponding one of the pair of buckles.

17. An adjustable infant carrier wearable by a user for carrying an infant, the infant carrier comprising:

a pair of shoulder straps;

a central panel coupled to the pair of shoulder straps and having an infant torso support portion and an infant bottom support portion;

a pair of adjustable side panels coupled to respective lateral portions of the central panel, each of the side panels extending along the infant torso support portion and the infant bottom support portion from one of the shoulder straps to the infant bottom support portion, each side panel having a respective lateral edge sized to extend beyond a corresponding shoulder of the infant when the infant is carried in the infant carrier and being adjustable relative to the central panel between a narrow configuration and a wide configuration, wherein the distance between the lateral edge and the central panel increases as the side panel transitions from the narrow configuration toward the wide configuration, each side panel further including a plurality of pleats which facilitate the formation of overlapping portions having corresponding degrees of overlap when the side panel is in the narrow configuration, the degree of overlap decreasing as the side panel transitions from the narrow configuration toward the wide configuration; and a pair of buckles, each of the buckles having a first portion connected to a respective one the shoulder straps and a second portion selectively engageable with the first portion and connected to a respective one of the pair of adjustable side panels, the lateral edge of each of the adjustable side panels extending from the second portion of a corresponding one of the pair of buckles.

* * * * *